US005520459A

United States Patent [19]

Yu et al.

[11] Patent Number: 5,520,459

[45] Date of Patent: May 28, 1996

[54] ENHANCEMENT OF FLOW MIXING BY A FREQUENCY TUNABLE CAVITY

[75] Inventors: Kenneth H. Yu; Klaus C. Schadow; Robert A. Smith, all of Ridgecrest, Calif.

[73] Assignee: The United States of America as represented by the Secretary of the Navy, Washington, D.C.

[21] Appl. No.: 273,031

[22] Filed: Jun. 30, 1994

[51] Int. Cl.[6] ..... B01F 5/00

[52] U.S. Cl. ..... 366/336; 181/213

[58] Field of Search ..... 366/124, 336, 366/337, 340; 138/37, 39; 48/180.1, 189.4; 181/213, 250, 273, 276

[56] References Cited

U.S. PATENT DOCUMENTS

| | | | |
|---|---|---|---|
| H1007 | 1/1992 | Schadow et al. . | |
| 3,671,208 | 6/1972 | Medsker | 48/189.4 X |
| 4,100,993 | 7/1978 | Feder | 181/213 |

OTHER PUBLICATIONS

K. Yu, E. Gutmark and K. Schadow; "Passive Control of Coherent Vortices in Compressible Mixing Layers"; American Institute of Aeronautics and Astronautics, Washington, D.C.; paper 93–3262 Jul. 6, 1993.

K. Yu, E. Gutmark, R. Smith and K. Schadow; "Supersonic Jet Excitation Using Cavity–Actuated Forcing"; American Institude of Aeronautics and Astronautics, Washington, D.C.; paper 94–0185, Jan. 10, 1994.

K. Yu and K. Schadow; "Cavity–Actuated Supersonic Mixing and Combustion Control"; to be presented at *the 25th International Symposium on Combustion;* Jul. 31, 1994 and to appear in *Combustion & Flame* (1994).

*Primary Examiner*—Charles E. Cooley

*Attorney, Agent, or Firm*—Stephen J. Church; Melvin J. Sliwka; John Forrest

[57] ABSTRACT

A shear layer of a fluid flow has relatively large vortical structures generated by acoustic forcing from oscillations induced in a cavity closely adjacent to the flow so that these structures enhance mixing at the layer. The forcing frequency is selected by varying the dimensions of the cavity, and several cavities of different dimensions may be provided for forcing at different frequencies, including beat frequencies. The cavity provides passive, high amplitude forcing effective with a compressible shear layer due to high speed flow, including supersonic flow. Cavities of differing configuration provide forcing for fluid flow from nozzles of different geometries. The most effective enhancement is provided by particular excitation frequencies generated by a cavity having a size selected in accordance with dimensionless relations between the flow parameters and nozzle geometry.

13 Claims, 5 Drawing Sheets

ENHANCEMENT OF FLOW MIXING BY A FREQUENCY TUNABLE CAVITY

BACKGROUND OF THE INVENTION

1. Field of the Invention

The invention pertains to enhancement of flow mixing by the use of flow-induced cavity resonance. More particularly, it pertains to passive control of mixing in high speed, compressible shear flows by a frequency tunable cavity.

2. Description of the Prior Art

Rapid and effective mixing in a fluid flow or jet is important in many applications such as mixing fuel and air for combustion in a turbulent shear layer between faster and slower moving fluid. Mixing in such a layer can be controlled by acoustic forcing at a frequency close to a naturally occurring frequency of vortical structures in the layer. In subsonic flow at low to intermediate Mach numbers the shear layer is relatively incompressible and has vortical structures that are relatively large and coherent in that their energy is contained in a particular frequency band or bands so that, in the prior art, the structures were excited by low level forcing using an active actuators such as a loudspeaker or the rotating valve shown in United States Statutory Invention Registration (SIR) H1007 which is incorporated in the present application by reference.

However, with higher Mach number flows at realistic Reynolds number conditions, as in supersonic combustion engines, the shear layer is compressible and the naturally occurring structures are small and are not very coherent so that high amplitude forcing is necessary to excite vortical structures effective for mixing. As a result, such prior art actuators are not powerful enough to overcome inherent disturbances from turbulence in the shear layer.

The forcing frequency or frequencies necessary to excite vortical structures, which are effective for mixing or other purposes, vary with factors such as the speed of the fluid, its material and temperature, and size of an associated nozzle so that, to be practically useful, an arrangement for excitation of such structures must be tunable to excite any frequency in a wide range of such frequencies. For enhanced mixing in some applications, it is desirable that such an arrangement provide excitation at more than one frequency. It is highly desirable that such forcing at the high amplitudes required by high speed flow be provided in such a way that energy of the flow not be substantially reduced or its direction undesirably deflected. It is also desirable that arrangements providing such forcing be adaptable to flow from nozzles of different geometries.

SUMMARY AND OBJECTS OF THE INVENTION

A mixing layer between fluids moving relative to each other has relatively large and highly coherent vortical structures induced into the layer in accordance with the present invention by flow excitation from oscillations in a cavity juxtapositioned to and opening at the flow in an open end of the cavity facing a shear layer plane so that flow oscillations are induced by flow over the cavity. The cavity is preferably placed at the region of shear layer development. Flow excitation from the cavity causes high-amplititude, discrete-frequency oscillations in the flow velocity and pressure of a shear layer so as to generate organized structures with dimensions much larger than naturally appearing flow structures in the layer. The cavity provides passive, high amplitude forcing particularly effective with, but not limited to, a shear layer in high speed flow, including supersonic flow. The passively generated structures may be used for vortical structure study, for control purposes with other arrangements involving vortex dynamic manipulation, or for directing noise from supersonic jets and shifting the energy of such noise from certain frequency bands, but are particularly effective to enhance mixing at the layer, as for fast mixing of fuel and air in supersonic combustion engines.

Such a cavity extends transversely of the overall flow direction and, typically, is of rectangular cross section. Such a cavity may be disposed tangentially of flow from a circular nozzle or along one or opposite sides of flow from a rectangular nozzle, and the cavity may extend partly or entirely circumferentially about flow from a circular nozzle.

The forcing frequency is selected by varying the dimensions of the cavity, and a plurality of cavities of different dimensions may be provided for forcing at different frequencies, including beat frequencies. The most effective enhancement is provided by particular excitation frequencies and these may be generated by a cavity having dimensions selected in accordance with dimensionless relations between the flow parameters and nozzle geometry, the cavity being believed particularly effective when longitudinal and transverse oscillations therein reinforce each other.

It is an object of the present invention to provide effective mixing between fluid flows, particularly parallel or nearly parallel flows.

Another object is to provide such mixing particularly effective in a compressible shear layer.

Still another object is to provide arrangements for enhancing such mixing and for control or other purposes by manipulating the dynamics of vortical structures by flow excitation forcing at the most effective frequency or frequencies.

Yet another object is to provide arrangements which provide the above and other advantages and are particularly useful with compressible shear layers.

A further object is to provide such arrangements which are fully effective, which are adaptable to fluid flows which are nonreacting or are reacting, as by combustion; and which may be applied to nozzles of different geometries without interference with fluid flow therefrom.

BRIEF DESCRIPTION OF THE DRAWINGS

Other objects, advantages, and novel features of the present invention will be apparent from the following detailed description when considered with the accompanying drawings wherein.

DETAILED DESCRIPTION

Figure 1:
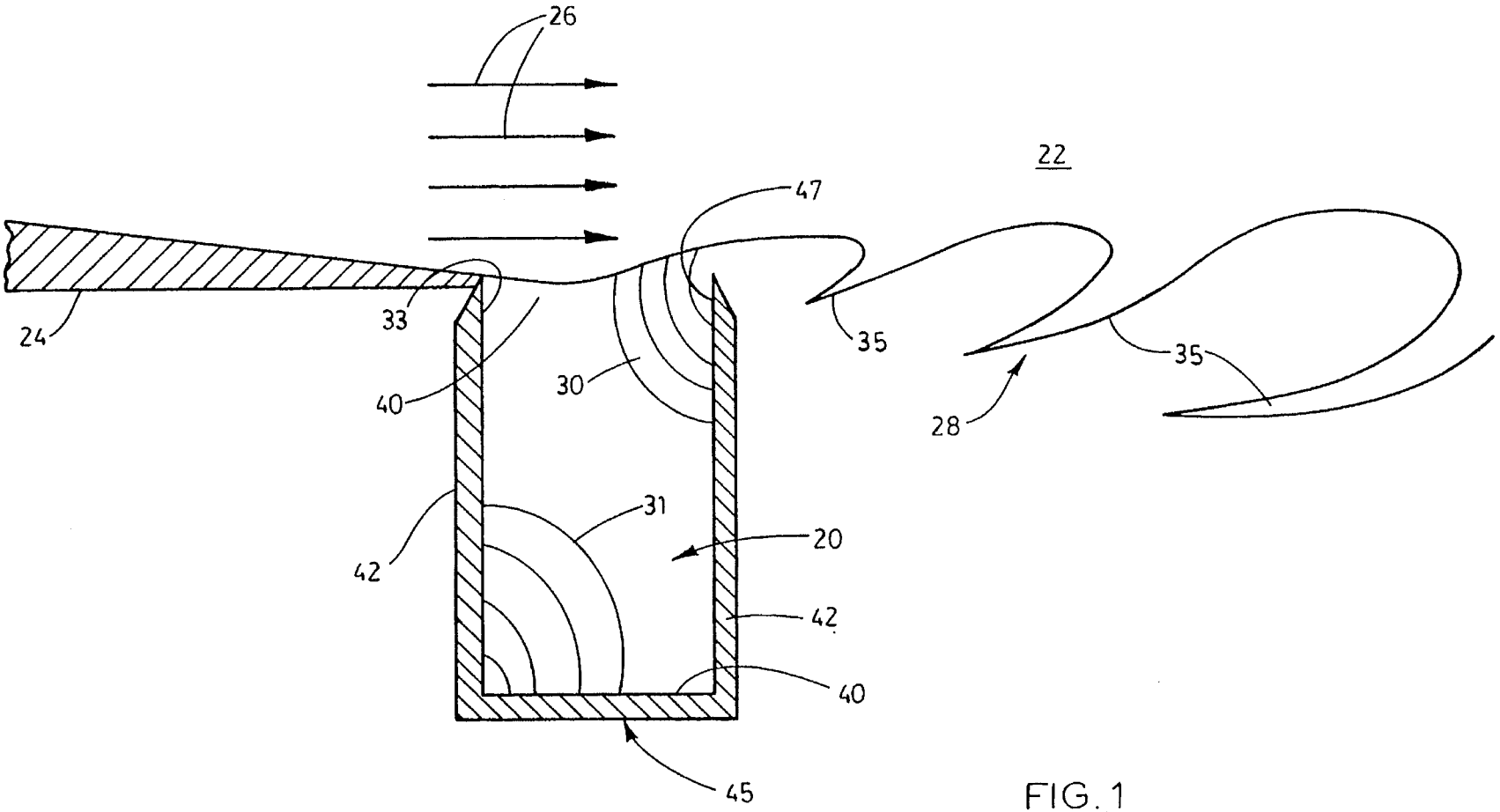
FIG. 1 is a somewhat schematic, fragmentary section along a fluid flow wherein vortical structures are excited in accordance with the present invention by acoustic forcing from oscillations in a cavity juxtapositioned to the flow.

FIG. 1 shows a fluid flow device constructed in accordance with the present invention for enhancement of flow mixing by an acoustic frequency tuned cavity 20. The cavity is associated with a fluid containing region 22 into which a fragmentarily represented orifice defining member or nozzle 24 directs, as indicated by arrows 26, a flow of fluid so that there is relative velocity difference between the fluids and a shear or mixing layer or region 28 develops between them. In the claims, the fluid in region 22 is sometimes referred to as a "first fluid" and the fluid in flow 26 is sometimes referred to as a "second fluid"; however, the present invention is effective with such fluids which may the same or different or are reacting, as by combustion.

Cavity 20 generates, in fluid therein and as subsequently described in detail, acoustic oscillations 30, which are propagated in a direction generally along flow 26 and are thus sometimes termed longitudinal oscillations, and acoustic oscillations 31, which are propagated in a direction generally normal to flow 26 and are thus termed transverse oscillations. These oscillations may have any mode or modes corresponding to the configuration of cavity 20 and to the acoustic velocity therein and, in the practice of the present invention preferably reinforce each other. Such an oscillation emanates from the cavity at an opening 33 thereof, which is juxtapositioned to flow 26 and disposed toward where the shear layer 28 develops, into the shear layer so as to acoustically excite the shear layer and force or enhance the development of vortical structures 35 in the shear layer.

The present invention thus provides vortical structures 35 even when shear layer 28 is compressible due to its high speed, including supersonic speed, or due to its being heated from combustion; and it is apparent that such vortical structures widen the shear layer and enhance mixing between the fluids in region 22 and flow 26. Since the opening 33 of cavity 20 is at flow 26, oscillations 30 and 31 are excited in the cavity by this flow so that no active device or actuator is required to drive the oscillations and the present invention functions passively and yet may provide substantial acoustic energy for forcing the vortical structures. This energy is fed back into the flow; and, as will be subsequently apparent, no element utilized with various embodiments of the present invention projects into region 22 or flow 26 so as to generate undesired turbulence therein. The present invention thus provides high amplitude oscillations to force and enhance such vortical structures without flow 26 being undesirably deflected or having its energy substantially reduced.

It is seen from the drawings that the FIG. 1 cavity 20, as well as corresponding cavities subsequently identified and best shown in FIGS. 3–6, have a configuration which is effective in the practice of the present invention and wherein the cavity has a cross section which is a rectangle in a plane extending along the direction of fluid flow corresponding to flow 26. A pair of opposite sides 40 of such rectangle correspond to a first dimension thereof along which oscillations 30 propagate and are substantially parallel to the direction of flow 26. One of these sides 40 is coincident with opening 33, the other of the sides 40 being closed. The other pair of sides 42 of such rectangle are those adjacent to opening 33 and correspond to a second dimension of the rectangle along which oscillations 31 propagate and which is transverse to flow 26, both of sides 42 being closed.

Said first dimension and said second dimension are, preferably, selected so that modes of acoustic oscillation in cavity 20 are mutually reinforcing as before stated. Preferably, these dimensions are also selected for resonance in cavity 20 of such oscillations at a frequency or frequencies effective to excite vortical structures 35. The closed sides, one of the sides 40 and both of the sides 42, may be constructed in any suitable manner, as by a unitary element 45 which thus defines cavity 20. Element 45 is supported in any suitable manner in relation to nozzle 24 so that cavity 20 with its opening 33 is disposed downstream of flow 26 in relation to the nozzle, the cavity, typically, being in juxtapositioned relation to the nozzle so that vortical structures 35 may be excited as soon as flow 26 exits therefrom. Opening 33 is juxtapositioned to one side of flow 26 at shear layer 28 so that this flow impinges on element 45 at the downstream edge side of opening 33, at a location identified by numeral 47, to generate oscillations 30 which, in turn, generate oscillations 31 by acoustic coupling therewith.

Figure 2:
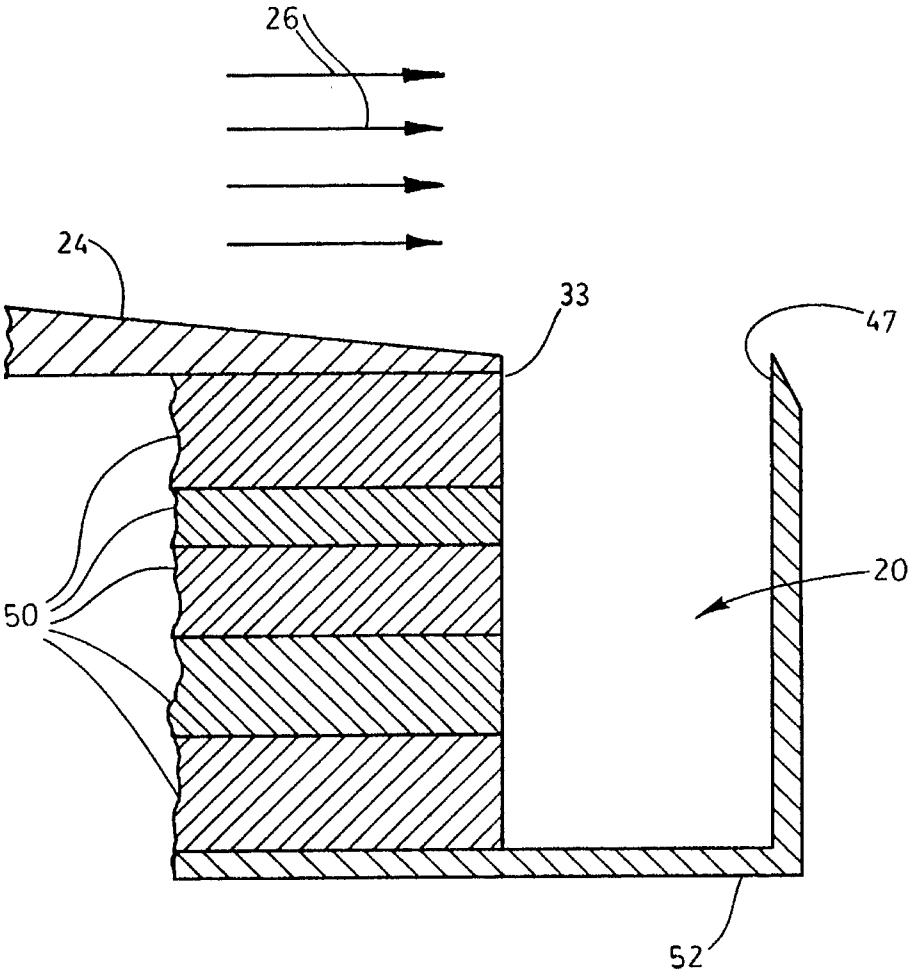
FIG. 2 is a section similar to FIG. 1 showing an arrangement for tuning the cavity by variation of its dimensions.

FIG. 2, wherein elements corresponding to those of FIG. 1 are identified by the same numerals, shows a structure for defining cavity 20 so that the dimensions of the cavity may be varied for tuning oscillations therein. This structure includes a plurality of interchangeable blocks 50 of different thickness to select the transverse dimension of the cavity and an L-shaped member 52 which is slidable in the direction of flow 26 along the one of the blocks 50 farthest from this flow and which terminates so as to define downstream edge 47 of opening 33.

Figure 6:
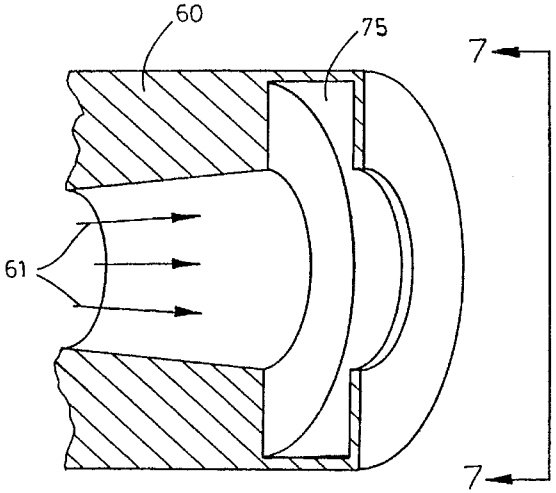
FIG. 6 is a somewhat schematic perspective view showing such a cavity which extends semicircularly and circumferentially around a jet of circular cross section.
Figure 7:
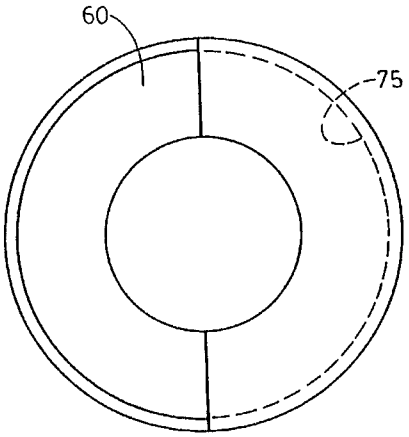
FIG. 7 is an axial view of the FIG. 6 structure taken from the position of line 7—7 of FIG. 6.

In FIG. 1, the balance of nozzle 24 is not shown as not directly involved in the practice of the present invention. However, such a nozzle is, typically, of conventional construction so as to define an orifice from which flow 26 issues with a predetermined flow cross section generally conforming to that of the orifice, and a cavity corresponding to cavity 20 is juxtapositioned to one side of the flow cross section. More specifically and as shown in FIGS. 3, 6, and 7, a nozzle 60 which is of generally circular configuration in a plane transverse to fluid flow therethrough may be employed to form a jet or fluid flow 61 of generally circular cross section wherein the shear layer, not specifically represented, is of generally hollow cylindrical form and extends circumferentially about the jet.

Figure 4:
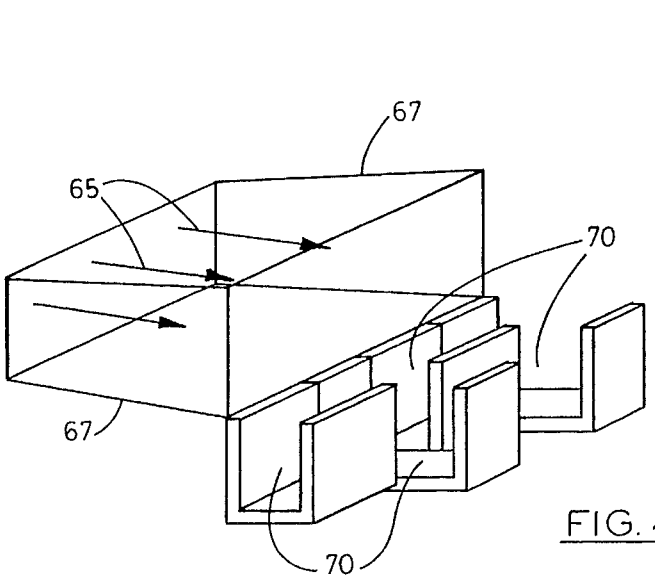
FIG. 4 is a somewhat schematic perspective view showing a plurality of such cavities which have different lengths for tuning at different frequencies and which are disposed along one side of a jet of rectangular cross section.
Figure 5:
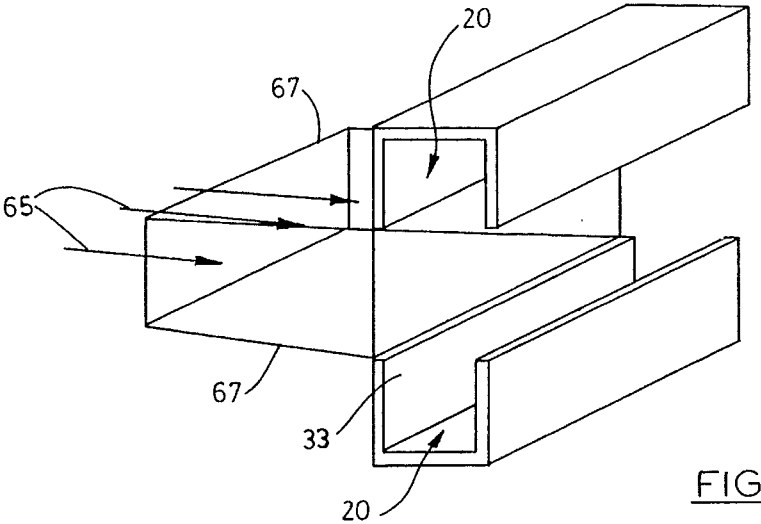
FIG. 5 is a somewhat schematic perspective view showing a pair of such cavities disposed along opposite sides of a jet of rectangular cross section.

Similarly and as shown in FIGS. 4 and 5, a nozzle of rectangular configuration, not shown as readily apparent to one skilled in the art, may be employed to form a jet 65 of generally rectangular flow cross section in a plane transverse to fluid flow through the nozzle. The jet thus has a pair of opposite flow sides 67 of generally planar configuration, these sides corresponding to shear layers, also not specifically represented.

Figure 3:
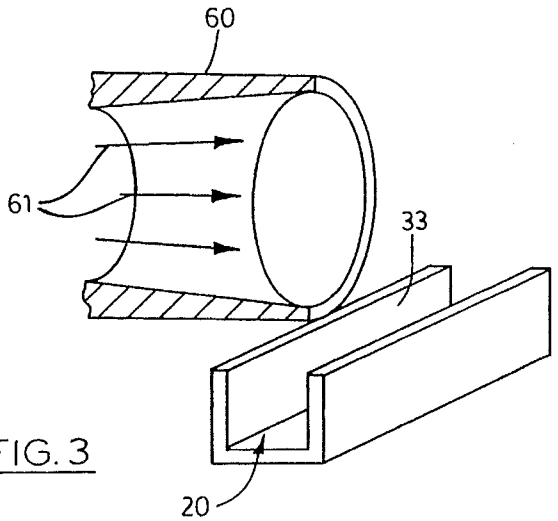
FIG. 3 is a somewhat schematic perspective view showing a single such cavity disposed tangentially to a jet of circular cross section.

Cavity 20 may, advantageously, be constructed in rectangular parallepiped configuration, as shown in FIGS. 3 and 5, with opening 33 as one of the sides of the parallepiped, this one side extending transversely of the direction of flow of jet 61 or jet 65. With a generally circular jet, such as jet 61 of FIG. 3, the opening has been found effective when generally tangentially related to the jet. With a generally rectangular jet, such as jet 65 of FIG. 5, the opening is, preferably, disposed at one of the flow sides 67, the use of a pair of cavities individually disposed at opposite flow sides 67 as shown in FIG. 5 also being effective.

The present invention may provide a plurality of forcing frequencies by the use of different dimensions for a cavity corresponding to cavity 20; so that, as shown in FIG. 4, a plurality of cavities 70 of different dimensions, but otherwise corresponding to cavity 20, may be provided for forcing at several frequencies of vortical structures corresponding to structures 35, including beat frequencies between the frequencies of the different cavities.

FIGS. 6 and 7 show a cavity 75 for use with a jet, such as jet 61 of generally circular cross section. Cavity 75 is of arcuate configuration in a plane extending transversely of the direction of the flow of such jet and extends circumferentially about the jet. Cavity 75 extends semicircularly about the jet, a configuration which provided access to the jet oppositely of the cavity for experimental purposes, but which also provided effective forcing in the jet of vortical structures corresponding to structures 35. However, any arcuate cavity similar to cavity 75, but of greater or lesser arcuate extent including a complete circle, is also effective in the practice of the present invention.

Figure 8:
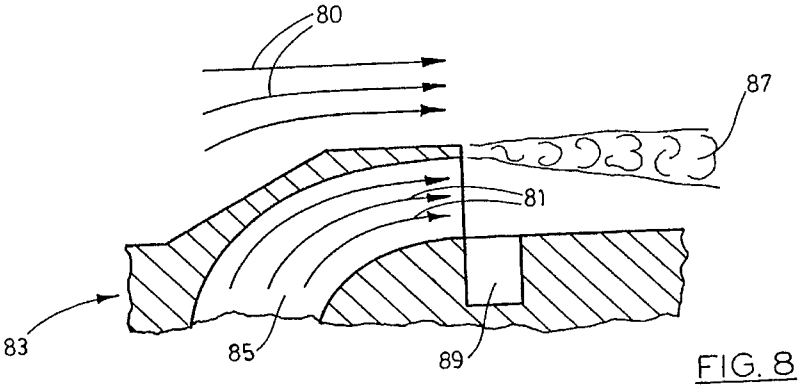
FIG. 8 is a fragmentary section of a combustion chamber embodying the present invention.

FIG. 8 shows an embodiment of the present invention wherein a flow 80 of a fluid, such as air, is being mixed with another flow 81 of a fluid, such as a gaseous fuel. Flow 80 is along and within a wall structure 83, such as a combustion chamber wall of a supersonic ramjet. Flow 81 is introduced along the wall from a nozzle 85 to move parallel to flow 80. Flows 80 and 81 have different speeds so that a shear layer, which corresponds to layer 28 of FIG. 1, develops in a region indicated by numeral 87 and mixes such air and fuel with combustion occurring as mixing occurs. Because of the high speeds of the flows and the temperature in the shear layer from such combustion the shear layer is highly compressible and mixing, which must occur rapidly because of the limited time in the chamber at such speeds, is undesirably slow without the use of the present invention because of the above described limited development of vortical structures in these circumstances. However, the use of a cavity 89, corresponding to the FIG. 1 cavity 20, in wall structure 83 and immediately downstream of nozzle 85, provides the necessary effective and rapid mixing.

A cavity, such as cavities 20, 70, 75, or 89, for use with the practice of the present invention is, as before stated, most effective when it provides particular excitation frequencies generated when the cavity has dimensions selected so that longitudinal and transverse oscillations therein reinforce each other. Experimental and theoretical results set forth in the following articles are believed helpful in assisting one skilled in the art of acoustic resonance to determine such dimensions:

K. Yu, E. Gutmark, and K. Schadow; "Passive Control of Coherent Vortices in Compressible Mixing Layers"; *American Institute of Aeronautics and Astronautics*, Washington, D.C.; paper 93–3262 Jul. 6, 1993.

K. Yu, E. Gutmark, R. Smith, and K. Schadow; "Supersonic Jet Excitation Using Cavity-Actuated Forcing"; *American Institute of Aeronautics and Astronautic*, Washington, D.C.; paper 94–0185, Jan. 10, 1994.

K. Yu and K. Schadow; "Cavity-Actuated Supersonic Mixing and Combustion Control"; to be presented at *the 25th International Symposium on Combustion*; Jul. 31 1994 and to appear in *Combustion & Flame* (1994)

These articles are incorporated in the present application by reference and copies of these articles are filed with the application in connection with the accompanying information disclosure statement under 37 C.F.R. 1.97(b).

The paper "Passive Control of Coherent Vortices in Compressible Mixing Layers" shows at page 6 that under specific test conditions a cavity, which corresponded to the cavity 20 described in the present application and shown in FIG. 3 thereof, having particular dimensions produced large scale structures corresponding to structures 35 were excited in supersonic flow. However and as noted at page 7, cavities of other dimensions were less effective. Equations (1)–(3) at pages 7–8, which are well-known to those skilled in the art of acoustic resonance, were applied to these cavities, as shown in Table 1 at page 8, with results consistent with the test conditions.

The paper "Supersonic Jet Excitation Using Cavity-Actuated Forcing" is believed relevant as disclosing in part 3, at pages 2–4, and in part 4, at page 4–5, conventional test techniques for use with the subject matter of the present application. In part 4, at page 4 it is noted that, as stated in the preceding paragraph, with a cavity like that in the present application and shown in FIG. 3, it is necessary to tune the cavity dimensions for suitable resonance therein. However and with a semicircular cavity like cavity 75 shown in the present FIGS. 6 and 7 the supersonic jet was excited at all frequencies although the cavity dimensions affected the frequencies excited in the jet.

Figure 10:
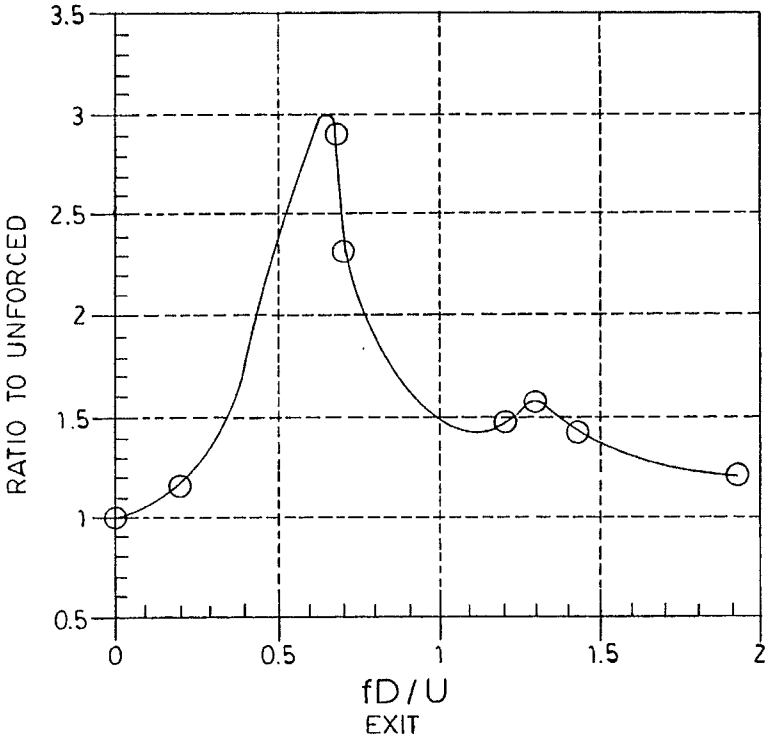
FIG. 10 is a graph showing relative enhancement of shear layer growth as a function of the forcing frequency represented by the Strouhal number.
Figure 9:
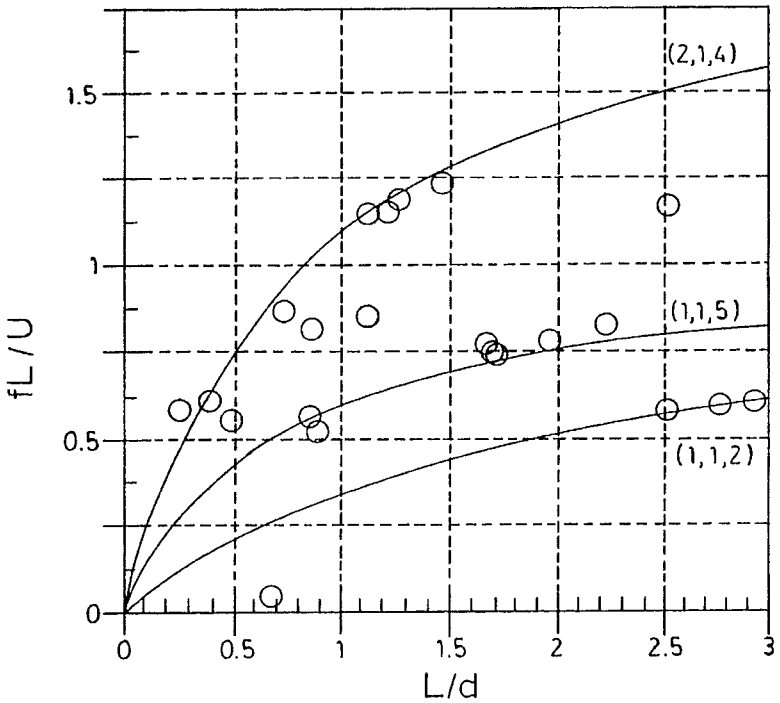
FIG. 9 is a graph showing a correlation between experimental and calculated possible forcing oscillation frequencies, represented by the Strouhal number, for three modes of oscillation over a range of cavity proportions.

As set forth in this paper at pages 6–7 with the use of conventional considerations and equations identified as equations (1)–(3)', the curves at page 8, which are those of the present FIG. 9, were obtained and correlate the experiments and theory. In this FIG. 9, the circles indicate experimental results and the three lines are curves representing calculated values for three modes of cavity oscillations noted by the lines. These curves show the length/depth ratio (L/d) of such cavities wherein the longitudinal and transverse oscillations modes advantageously couple for the practice of the subject matter of the present invention. This paper, as described at page 8, also describes experiments using conventional techniques to quantify the shear layer growth as effected by the subject matter of the present application for particular frequencies exciting vortical structures corresponding to structures 35. The results of these experiments are shown in the paper at page 9 in FIG. 14, which is substantially the present FIG. 10 wherein the circles indicate experimental results to which the curve is fitted. The frequencies in all of these figures are expressed as the Strouhal number, fL/U or fD/U, relating the parameters of frequency (f), cavity length (L) or orifice diameter (D), and jet velocity (U) so that desirable frequencies may be determined for structures incorporating the subject matter of the present application without limitation to specific values of such parameters.

The paper "Cavity-Actuated Supersonic Mixing and Combustion Control" is believed relevant as including, at pages 3–4 and FIG. 2, equations and test result examples believed helpful for determining the dimensions of cavities, which correspond to the cavities 20, 70, and 75 described in the present application and shown in the drawings thereof, to provide desirable resonant frequencies for oscillations in such cavities. These equations and examples may be described as set forth in following four paragraphs.

With the test techniques used above, supersonic jets were discharged freely into the atmosphere. In a first case the jet was unheated air at Mach 2 and three cavities like that shown in the present FIG. 3 were used. The respective length and width dimensions of the cavities were: cavity 1, 23 and 24 mm; cavity 2, 10 and 9 mm; cavity 3, 24 and 11 mm. Only cavity 1 was effective for forcing the development of vortical structures like structures 35.

Assuming, as before stated, that the source of acoustic energy was impingement on the downstream cavity edge corresponding to an edge 47 of the present FIGS. 1 and 2, the fundamental period of the longitudinal oscillations is $T_o=L/U_s+L/a$, where L is the cavity length, $U_s$ is the shear layer velocity, and a is the acoustic velocity. Including higher harmonics, the actual period is $T_o/N$, where N is an integer. From the phase consideration, the resonance frequency is $f_N=NU_sa/L(U_s+a)$. However, the actual disturbance is in the transverse direction in accordance with the transverse resonance of the cavity which, neglecting acoustic radiation and for a simple cavity like that of the present FIG. 3, is $f_M=(2M1)a/4D$ a/4D where d is the cavity depth and M is an integer. Coupling between the longitudinal and transverse resonances is expected when $f_N$ and $f_M$ are about equal which will occur when $L/d=[(2M\ 1)/4N]\ (1+a/U_s)$. Of the three above-identified cavities, which has this L/d ratio produced successful forcing of the desired vortical structures. However and as pointed out above, this condition is not needed for semicircular cavities like cavity 75 of the present FIGS. 6 and 7.

In a second case the jet was also at Mach 2 and was heated air at 1300° K. as an intermediate step between cold non-reacting jets and jets reacting and heated by combustion. Semicircular cavities like cavity 75 of the present FIGS. 6 and 7 were used since, as before stated, forcing of vortical structures corresponding to structures 35 would be more difficult due to the higher convective Mach number. The respective length and width dimensions of the three semicircular cavities used were: cavity 4, 23 and 18 mm; cavity 5, 23 and 21 mm; cavity 3, 23 and 25 mm. All of the cavities resulted in the desired forcing, and cavity 6 with the lowest frequency forcing at 15.5 KHz was the most effective.

In the third case, the cavity 6 was used with jets at Mach 2 reacting by the combustion of ethylene. The jet was fuel-rich so that, when the jet entered the atmosphere, mixing in a shear layer corresponding to layer 28 of the present FIG. 1 resulted in combustion with atmospheric oxygen. When the jet temperature was 1480° K. with combustion near the flame extinction temperature and with forcing of vortical structures corresponding to structures 35 by the cavity the flame intensity and length were reduced significantly in comparison with such a jet not subjected to such forcing; evidently because of enhanced mixing with the cold ambient flow. However and when the jet temperature was 1560° K., the increased mixing due to such forcing in accordance with the present invention resulted in more intense and shorter flames.

Obviously, many modifications and variations of the present invention are possible in light of the above teachings. It is, therefore, to be understood that the present invention may be practiced within the scope of the following claims other than as described herein.

What is claimed is:

1. In a device having a region containing a first fluid and having a nozzle directing a flow of a second fluid into said region for mixing of said fluids by vortical structures developing in a shear layer between said fluids, an improvement for use in such a device wherein said flow of said second fluid is at a speed relative to said first fluid such that naturally occurring said vortical structures are insufficient to provide said mixing, wherein the improvement comprises an element defining a cavity disposed transversely of said flow and downstream of said flow from said nozzle, said cavity having an opening having a dimension along said flow and a dimension transversely of said flow, and said opening being juxtapositioned to said shear layer so that said cavity contains said fluids and said flow at said opening excites in said fluids contained in said cavity acoustic oscillations that emanate from said cavity into said shear layer and force the development of said vortical structures in said shear layer to widen said shear layer with mixing of said fluids at said shear layer.

2. The improvement of claim 1 wherein said cavity has a substantially rectangular cross section in a plane extending along said flow and said dimension of said opening along said flow is substantially aligned with one side of said rectangular cross section.

3. A fluid flow device for use with a region containing a fluid, the device comprising:

means for directing a fluid flow into said region in a predetermined flow direction so that a shear layer develops between said flow and said fluid; and means for defining a cavity having an opening disposed at said shear layer so that said cavity contains fluid and so that acoustic oscillations in said fluid contained in said cavity excite vortical structures in said shear layer.

4. The fluid flow device of claim 3 wherein said means for directing said flow is an orifice and, in said flow direction, said opening is juxtapositioned to said orifice.

5. The fluid flow device of claim 3 wherein said cavity has a cross section which is substantially a rectangle in a plane extending in said flow direction and said opening corresponds to one side of said rectangle.

6. The fluid flow device of claim 5 wherein a first dimension of said rectangle corresponds to said one side and a second dimension of said rectangle corresponds to a side of said rectangle adjacent to said one side and wherein said first dimension and said second dimension are selected so that a mode of said acoustic oscillations in said cavity along said first dimension reinforces a mode of said acoustic oscillations in said cavity along said second dimension.

7. The fluid flow device of claim 5 wherein said means for directing said flow is configured so that said fluid flow is generally rectangular and has a flow side extending transversely of said flow direction and wherein said cavity is substantially a rectangular parallelepiped having said opening as a side of said parallelepiped extending transversely of said flow direction at said flow side.

8. The fluid flow device of claim 5 wherein said means for directing said fluid flow is configured so that said fluid flow is generally circular in a plane transversely of said flow direction.

9. The fluid flow device of claim 8 wherein said cavity is substantially a rectangular parallelepiped having said opening as a side of said parallelepiped extending transversely of said flow direction and generally tangentially related to said fluid flow.

10. The fluid flow device of claim 8 wherein said cavity is arcuate in a plane extending transversely of said flow direction, and said cavity extends circumferentially about said fluid flow.

11. The fluid flow device of claim 3 wherein said cavity has predetermined dimensions selected for resonance with said acoustic oscillations in said fluid contained in said cavity at a frequency effective to excite said vortical structures in said shear layer.

12. The fluid flow device of claim 11 wherein said cavity is one cavity of a plurality of such cavities having different dimensions selected for resonance with said acoustic oscillations in said fluid contained in the cavities, the dimensions of each of said cavities being selected for said resonance at different frequencies together effective to excite said vortical structures in said shear layer.

13. A method of enhancing mixing in flowing fluid at a compressible shear layer in said fluid, the method comprising providing a flow of said fluid in a predetermined direction and with a predetermined flow cross section having a side; and providing a cavity having an opening juxtapositioned at said side of said flow cross section so that said cavity contains said fluid and said flow excites acoustic oscillations of said fluid contained in said cavity and so that said oscillations enhance the development of vortical structures in said shear layer.

* * * * *